US008844785B2

(12) United States Patent
Myburgh

(10) Patent No.: US 8,844,785 B2
(45) Date of Patent: Sep. 30, 2014

(54) POWERED STAPLER AND METHOD OF OPERATING SAME

(76) Inventors: Herman Myburgh, Lascassas, TN (US); Sonette Myburgh, legal representative, Lascassas, TN (US)

( * ) Notice: Subject to any disclaimer, the term of this patent is extended or adjusted under 35 U.S.C. 154(b) by 719 days.

(21) Appl. No.: 13/146,128

(22) PCT Filed: Jan. 8, 2010

(86) PCT No.: PCT/US2010/020434

§ 371 (c)(1),
(2), (4) Date: Jul. 25, 2011

(87) PCT Pub. No.: WO2010/085379

PCT Pub. Date: Jul. 29, 2010

(65) Prior Publication Data

US 2012/0024930 A1 Feb. 2, 2012

Related U.S. Application Data

(60) Provisional application No. 61/202,056, filed on Jan. 26, 2009.

(51) Int. Cl.

| | |
|---|---|
| ***B31B 1/70*** | (2006.01) |
| ***B25F 3/00*** | (2006.01) |
| ***B25C 5/02*** | (2006.01) |

(52) U.S. Cl.

CPC ..... *B25F 3/00* (2013.01); *B25C 5/0292* (2013.01)

USPC ..... 227/19; 227/107

(58) Field of Classification Search

CPC ..... B25C 5/02; B25C 5/15

USPC ..... 227/19, 130, 144, 176.1, 175.1, 128, 227/107, 108; 606/153

See application file for complete search history.

(56) References Cited

U.S. PATENT DOCUMENTS

| | | | | |
|---|---|---|---|---|
| 3,743,161 | A * | 7/1973 | Spencer | 227/124 |
| 5,452,836 | A | 9/1995 | Huitema et al. | |
| 5,560,532 | A | 10/1996 | Defonzo et al. | |
| 5,782,397 | A * | 7/1998 | Koukline | 227/176.1 |
| 5,833,695 | A | 11/1998 | Yoon | |
| 7,431,188 | B1 | 10/2008 | Marczyk | |

* cited by examiner

*Primary Examiner* — Andrew M Tecco
*Assistant Examiner* — Nathaniel Chukwurah
(74) *Attorney, Agent, or Firm* — Howard M. Cohn; Daniel Cohn

(57) ABSTRACT

A powered stapler (10) and method of operating same for stapling together two or more metal workpieces. The powered stapler (10) includes a main frame member (20) adapted to carry a strip of staples. The frame member has an anvil (20*e*) covered by a front nosepiece (48) at one end. A lower jaw member (22), having a lower cam slot (34), is pivotally attached to the main frame member. The lower jaw member (22) has a forming die (56). An upper ram member (24) has an upper cam slot (32) and a staple-driving hammer (52). The upper ram member (24) is pivotally attached to the lower jaw member (22). A drive rod (28) extends from a power unit (12) and has a cam bar (30) at one end protruding through the upper cam slot (32) in the upper ram member (24) and through the lower cam slot (34).

20 Claims, 5 Drawing Sheets

POWERED STAPLER AND METHOD OF OPERATING SAME

CROSS-REFERENCE TO RELATED APPLICATIONS

This application claims the benefit of U.S. Provisional Patent Application No. 61/202,056 filed on Jan. 26, 2009, which is incorporated herein by reference.

TECHNICAL FIELD OF THE INVENTION

The present invention relates generally to tools used in the metal stud framing trade, and more particularly to a powered stapler for use in attaching metal framing studs to metal "C" tracks.

BACKGROUND OF THE INVENTION

The current practice of attaching light gauge metal framing studs to light gauge metal "C" tracks as employed in the metal stud framing or building construction trade, generally involves the use of threaded fasteners.

A threaded fastener is placed onto the driver point of a powered screw driver. The powered screw driver is then held in one hand of an installer while a metal framing stud is held in place inside the metal "C" track with the installer's other hand. The powered screw driver in the one hand is then positioned over the intersection of the metal stud and the "C" track. Next, the powered screw driver is activated to drill the fastener through both metal surfaces of the metal "C" track and the framing stud thereby screwing the two components together.

Self feeding, powered screw drivers are also available for this application but are seldom used due to the cost of the "coiled" fasteners, the bulkiness of the self feeding screw drivers and the time consuming reloading of the fasteners for these types of screw drivers.

The current practice of attaching metal framing studs to metal "C" tracks, as described above, is plagued with numerous difficulties in addition to having to perform these functions working on ladders and scaffolds.

For example, a threaded fastener placed onto the driver point of a powered screwdriver is held in place by magnetism in the magnetized driver point. Friction between the driver point and the fastener created by holding the powered screwdriver with the mounted fasteners vertically to prevent the fastener from falling off. Accidentally bumping the screwdriver or fastener against anything will easily dislodge the fastener from the driver point causing the fastener to fall off. This can be a common occurrence, which wastes productive time.

When holding the screwdriver with the mounted fastener in place for screw insertion to begin, it is of utmost importance that the fastener be held perpendicular to the metal surface. Failure to do this will cause the spinning fastener to "walk" off the intended location and possibly completely slip off the surfaces to be fastened together.

Without proper finger control by the installer or correct clutch setting on powered screw drivers so equipped, there is a strong likelihood of over tightening and thereby stripping out the treaded fastener. The star/hex head of threaded fasteners, commonly used for attaching metal framing studs to metal "C" tracks, is relatively expensive. Moreover, even when the star/hex head of threaded fasteners are installed, there is left significant high spots on the surface upon which fragile, flat gypsum board will be installed.

Other difficulties encountered in the current practice of attaching metal framing studs to metal "C" tracks includes: fasteners not correctly installed causing the fastener head to be angled or not driven in flush; and the two metals separating when installing the fastener requiring the operator to "pull" the inner metal surface towards the outer metal surface to obtain traction for the spinning fastener. In addition to the above, the current practice of attaching metal framing studs onto metal "C" tracks can be too much required from one person.

The present invention is provided to overcome and solve the aforementioned problems.

SUMMARY OF THE INVENTION

The powered stapler of the present invention has a longitudinal frame member attached to a power unit, a lower longitudinal jaw hinge attached to the longitudinal frame member incorporates the staple-forming die.

An upper longitudinal ram is hinge attached to the lower longitudinal jaw and incorporates a staple-driving hammer. A cam actuating shaft is guided inside the frame member and when extended longitudinally forward by the power unit, causes the lower jaw to clamp onto the frame while causing the ram to move the hammer through a nosepiece at the end of the upper longitudinal ram and project a staple into strips of metal being secured together. When the actuating shaft is extended, the jaw and the upper longitudinal ram are pulled together by cam action through longitudinal cam slots located in both the jaw and the upper longitudinal ram.

According to the present invention there is disclosed a powered stapler for stapling together two or more metal workpieces. The powered stapler includes a main frame member adapted to carry a strip of staples. The frame member has an anvil covered by a front nosepiece at one end. A lower jaw member, having a lower cam slot, is pivotally attached to the main frame member. The lower jaw member has a forming die. An upper ram member has an upper cam slot and a staple-driving hammer. The upper ram member is pivotally attached to the lower jaw member. A drive rod extends from the power unit and has a cam bar at one end protruding through the upper cam slot in the upper ram member and through the lower cam slot in the lower jaw member. The power unit is mounted to the powered stapler for reciprocally driving the drive rod whereby the forming die engages the anvil for clamping the two or more metal work pieces together and for driving the staple driving hammer between the front nosepiece and the anvil for dispensing a staple and driving the staple through the two or more metal work pieces whereby the staple is formed against the forming die.

Still further according to the present invention, the reciprocating drive rod has a first end portion which is mounted to the power unit and an opposite end portion that is transversely connected to the cam bar.

Yet further according to the present invention, the main frame member is mounted at an opposite end to the power unit.

Also according to the present invention, the power unit has a front end that includes a cylindrical end housing into which the first end portion reciprocating drive rod is received and mounted to the power unit.

Moreover according to the present invention, the front end of the power unit can rotate about 90 degrees in either direction about an axis through the main frame member.

Further according to the present invention, the upper ram member includes an upper sidewall and a lower sidewall and the lower jaw member includes an upper sidewall and a lower sidewall.

Still further according to the present invention, the cam slot in the upper ram member includes a first cam slot in the upper sidewall and a second cam slot in the lower sidewall. The first and second cam slots are parallel to each other and disposed one above the other.

Yet further according to the present invention, the cam slots of the upper ram member have parallel edges extending at an angle from an elongated edge surface of upper ram member towards the frame.

Also according to the present invention, the width of the cam slots is slightly more than the width of the cam bar so that when the upper ram member is assembled to the lower jaw member, the cam bar can easily move in the slots.

Moreover according to the present invention, the sidewalls of the lower jaw member are fitted between the sidewalls of the upper ram member.

Further according to the present invention, both the upper ram member and the lower jaw member are secured to the main frame so that the cam bar can easily move through both the slots and the slots so as bring together the upper ram member and the lower jaw member.

According to the present invention, a method for stapling together two or more metal workpieces comprises: providing a main frame member adapted to carry a strip of staples, the frame member having an anvil covered by a front nosepiece at one end and being mounted; pivotally attaching a lower jaw member having a lower cam slot and a forming die at one end to the main frame member; pivotally attaching an upper ram member to the lower jaw member, the upper ram member having an upper cam slot and a staple-driving hammer at one end; reciprocally driving a drive rod having a cam bar at one end protruding through the upper cam slot in the upper ram member and through the lower cam slot in the lower jaw member whereby the forming die initially engages the anvil for clamping the two or more metal work pieces together and for subsequently driving the staple driving hammer between the front nosepiece and the anvil for dispensing a staple and driving the staple through the two or more metal work pieces whereby the staple is formed against the forming die.

Further according to the present invention, the method includes mounting a first end portion of reciprocating drive rod to a cylindrical end housing of a power unit that can rotate in either direction and an opposite end portion to the cam bar.

Still further according to the present invention, the method includes rotating the front end of the power unit about 90 degrees in either direction with respect to the main frame member.

Yet further according to the present invention, the method includes separating the forming head and the end of the main frame from each other when the cam bar is at aft position at the ends of upper cam slots and lower cam slots so that the two or more work pieces can be disposed between them.

Also according to the present invention, the method includes moving the cam bar along cam slots and cam slots from the aft rest position to the fully forward position whereby the lower jaw will close the end against the anvil of the main frame.

Moreover according to the present invention, the method includes simultaneously moving upper ram with the movement of the lower jaw thereby clamping the lower jaw onto the anvil as well as moving the pivotally attached hammer between the nosepiece and the anvil whereby the hammer separates a staple from a strip, forcing the staple through the materials to be attached and then fold-forming the staple against the lower jaw forming die.

Further according to the present invention, the method includes moving the cam bar along the cam slots in the ram causing the upper ram to travel over both the lower jaw as well as over the main frame and the nose piece.

These and other features of the present invention will become readily apparent upon further review of the following specification and drawings.

BRIEF DESCRIPTION OF THE DRAWINGS

The operation and advantages of the present invention will become apparent upon consideration of the description herein taken in conjunction with the accompanying figures. The figures are intended to be illustrative, not limiting. Certain elements in some of the figures may be omitted, or illustrated not-to-scale, for illustrative clarity.

In the drawings accompanying the description that follows, both reference numerals and legends (labels, text descriptions) may be used to identify elements. If legends are provided, they are intended merely as an aid to the reader, and should not in any way be interpreted as limiting.

Although the invention is generally described in the context of these preferred embodiments, it should be understood that the figures are not intended to limit the spirit and scope of the invention to these particular embodiments.

Figure 1:
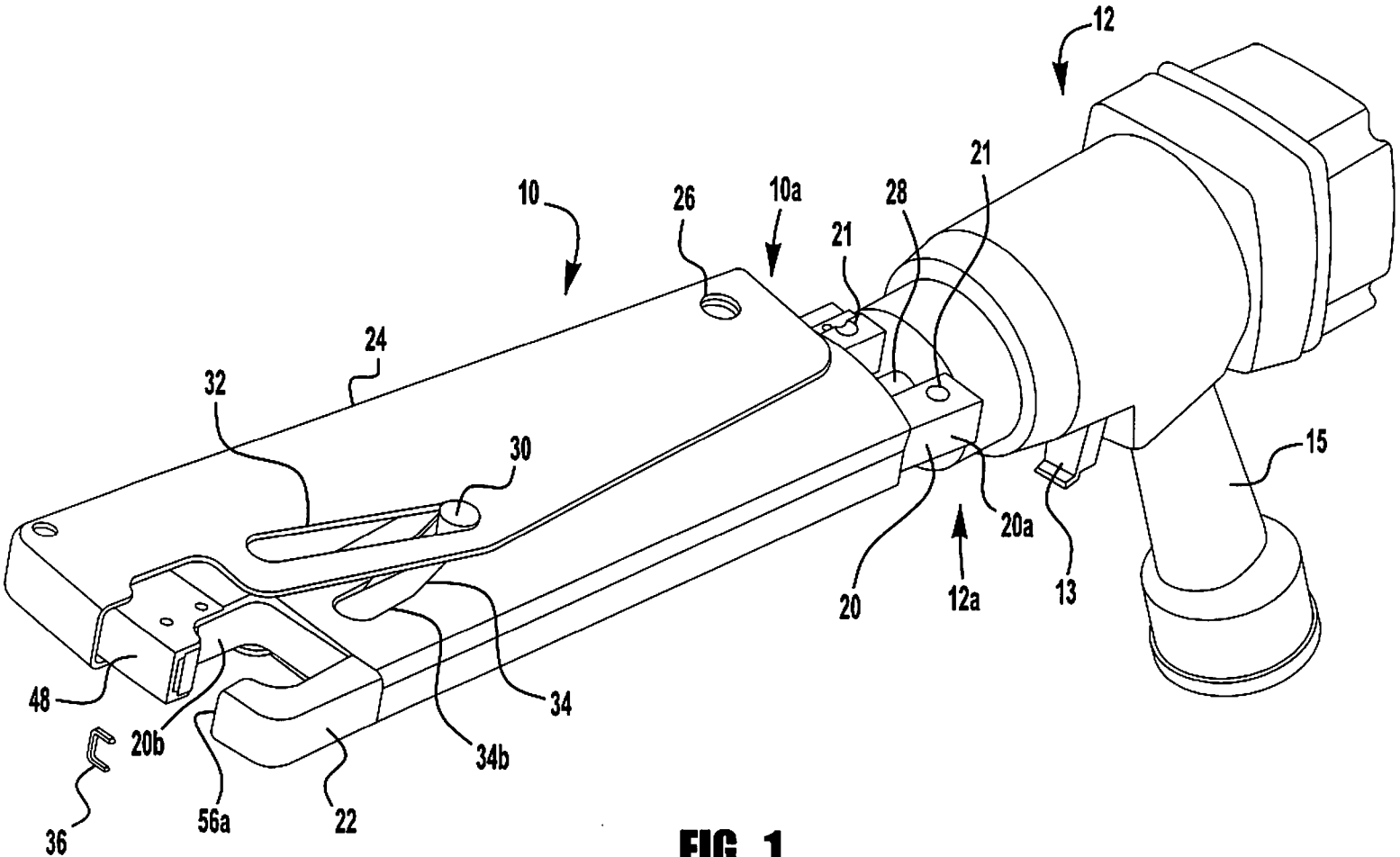

The figures submitted include the following:

FIG. 1 is a perspective view of the powered stapler with the longitudinal ram and the lower longitudinal jaw in an opened condition according to the present invention.

Figure 2:
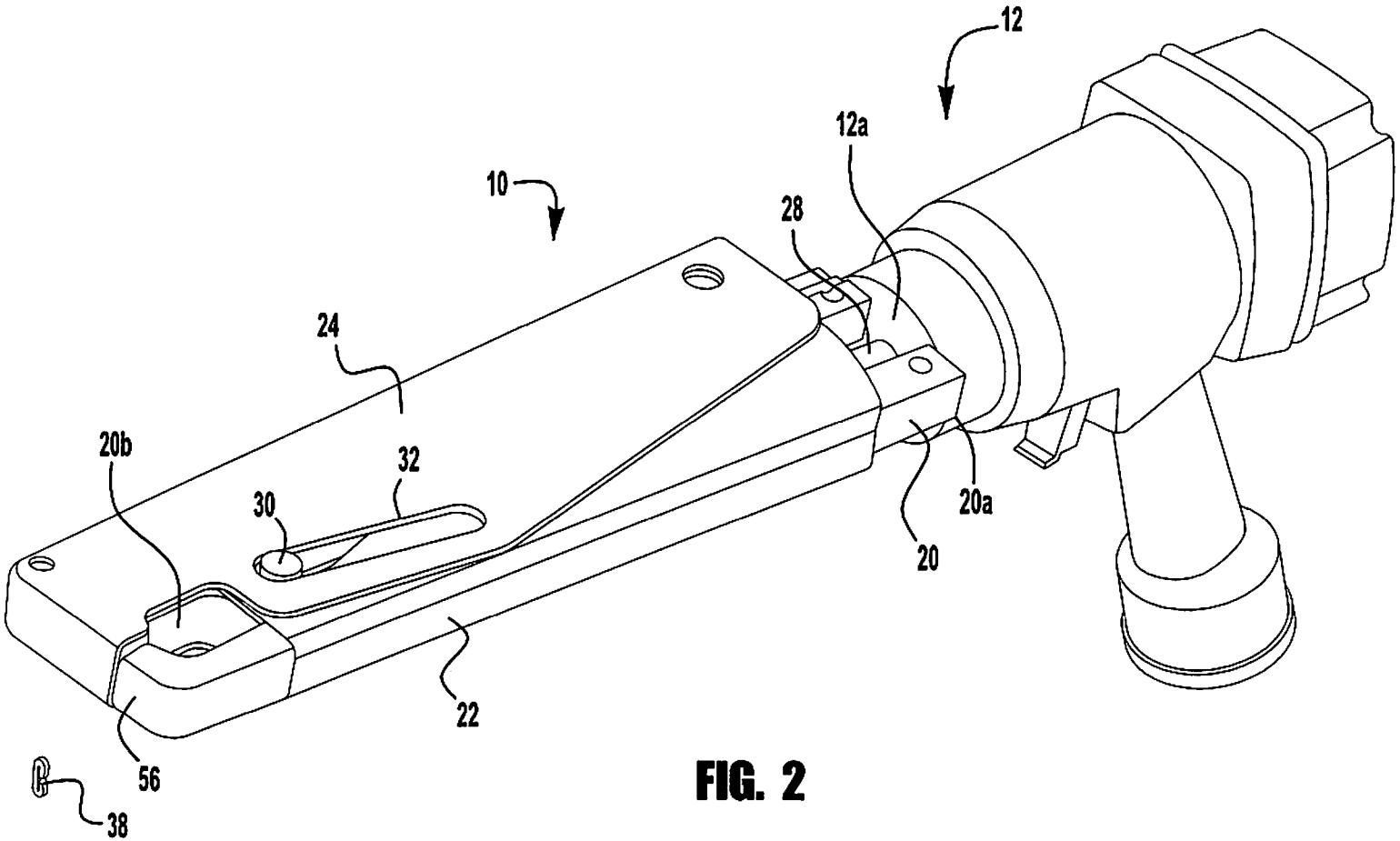

FIG. 2 is a perspective view of the powered stapler with the longitudinal ram and the lower longitudinal jaw in a closed condition according to the present invention.

Figure 3:
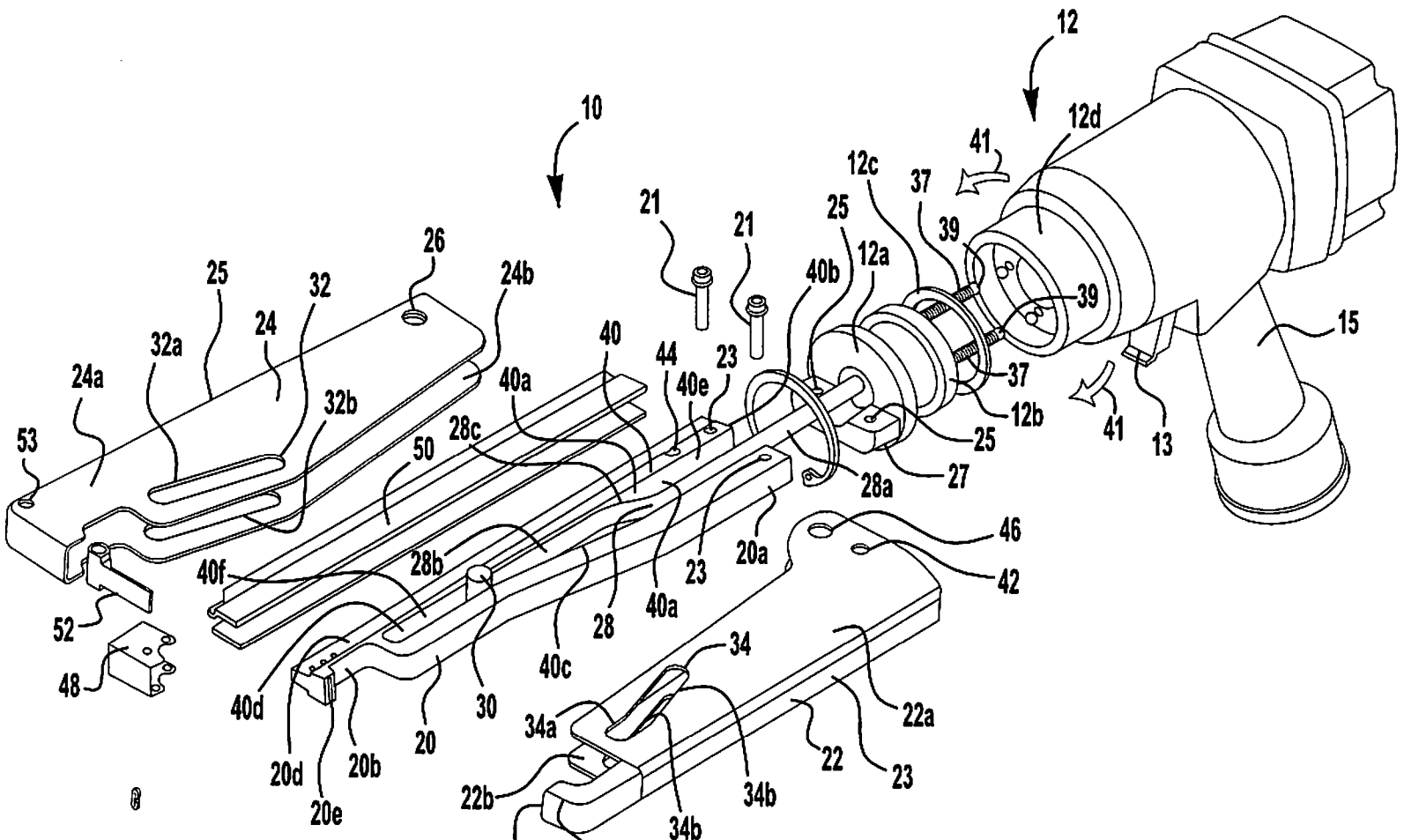

FIG. 3 is a perspective exploded view of the powered stapler and the power unit according to the present invention.

Figure 4:
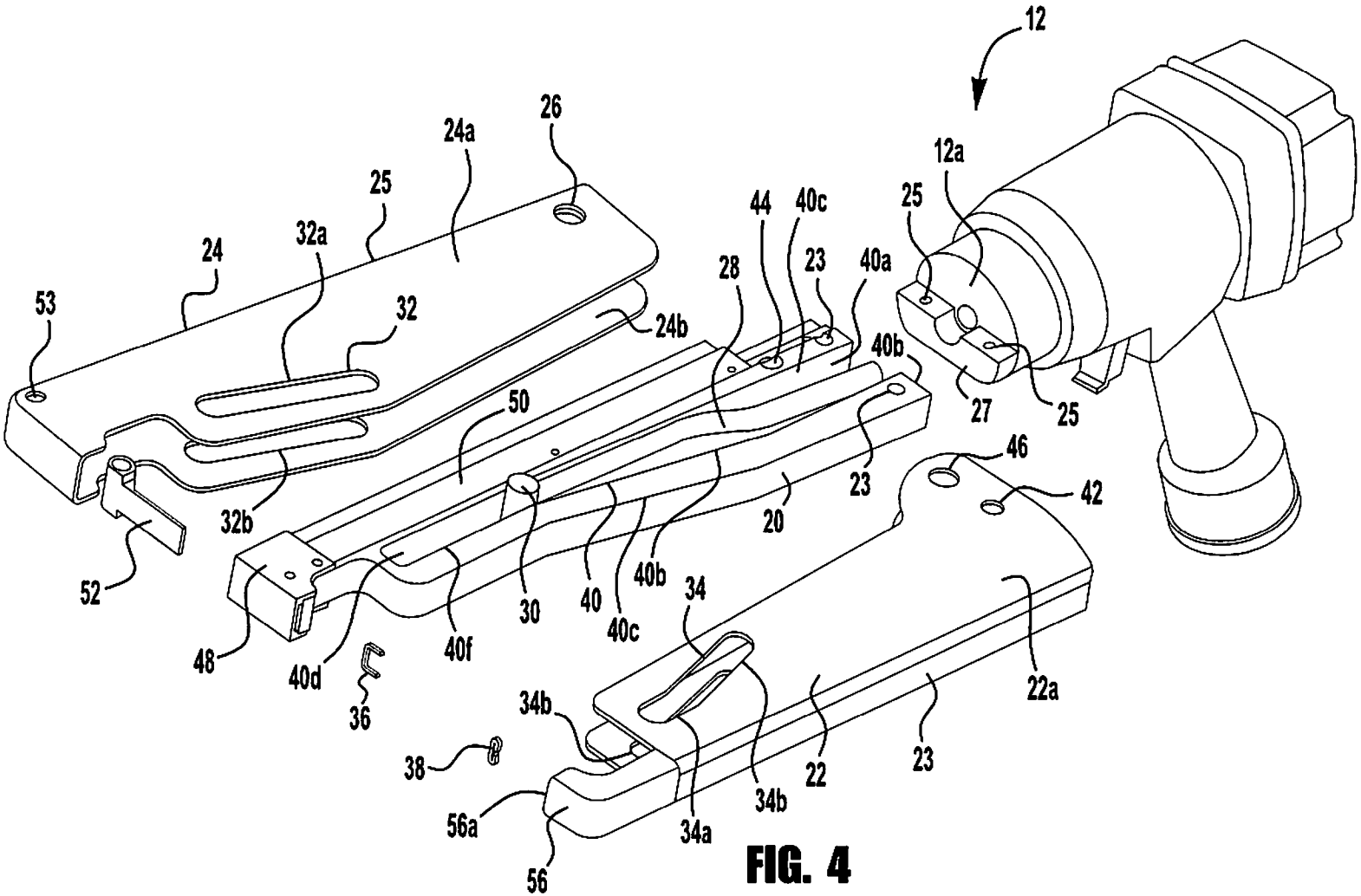

FIG. 4 is a perspective exploded view of the powered stapler and the power unit with the collar for attaching the power stapler mounted to the power unit according to the present invention.

Figure 5:
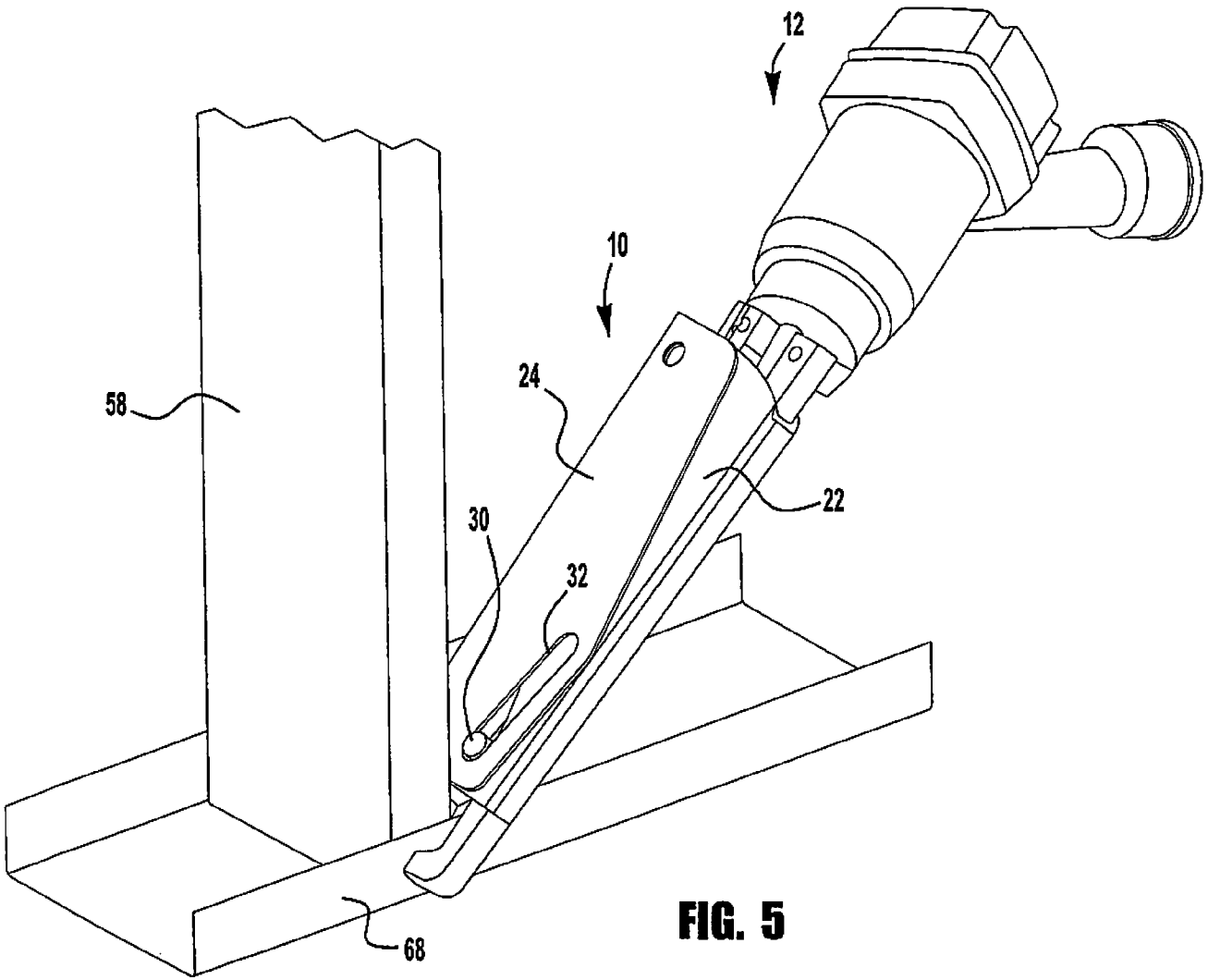

FIG. 5 is a perspective view of the powered stapler according to the present invention showing its placement on a metal stud and "C" track to be fastened together.

DETAILED DESCRIPTION OF THE PREFERRED EMBODIMENTS

In the description that follows, numerous details are set forth in order to provide a thorough understanding of the present invention. It will be appreciated by those skilled in the art that variations of these specific details are possible while still achieving the results of the present invention. Well-known processing steps and materials are generally not described in detail in order to avoid unnecessarily obfuscating the description of the present invention.

In the description that follows, exemplary dimensions may be presented for an illustrative embodiment of the invention. The dimensions should not be interpreted as limiting. They are included to provide a sense of proportion. Generally speaking, it is the relationship between various elements, where they are located, their contrasting compositions, and sometimes their relative sizes that is of significance.

FIGS. 1 and 2 show perspective views of a powered stapler 10 according to the present invention. The powered stapler 10 is mounted to an air driven power unit 12 (also referred to as power unit herein). It should be understood that the powered stapler of the present invention could be powered by any or a combination of power units including but not limited to battery, pneumatic, electric, and hydraulic or fuel cell.

As is well known in the art, the air driven power unit 12 can contain a cylinder (not shown) with a piston (not shown) to which a reciprocating drive rod 28 is affixed. One end 20*a* of the main frame 20 of stapler 10 is mounted to the power unit 12 (see FIG. 3) and receives the reciprocating drive rod 28. The opposite end 20*b* of the main frame 20 is deposed between the lower jaw forming die 56, the anvil 20*e* and front nosepiece 48 of the stapler 10, as discussed in detail hereinafter.

The power unit 12 includes a main air valve (not shown) which, when open, allows pressurized air to enter the cylinder and drive the piston and the drive rod 28 outwardly, from the forward end 12*a* of the power unit causing a staple 36 to be dispensed from the main frame member 20. The staple 36 can be used to pierce the metal pieces to be joined, as shown in FIG. 5 and to be clinched against the metal pieces by virtue of the anvil 20*e* pressing against the staple which is backed up by the lower jaw forming die 56. The main air valve of power unit 12 can be actuated by a manual trigger 13, as is well known in the art. The lower end of the handle portion 15 of power unit 12 can be provided with a fitting (not shown) which may be a quick connect/disconnect fitting for an air hose (not shown) from a source of pressurized air (not shown). Portions of the power unit 12 and the handle 15 can constitute a reservoir for pressurized air, again as is well known in the art.

Referring to FIGS. 1, 2 and 3, the main frame member 20 is attached to the power unit 12 in any convenient manner. For example, screws 21 are disposed through bores 23 and threaded into threaded screw holes 25 in a collar 27 which in turn is secured to the front end 12*a* of power unit 12, as seen in FIG. 4.

As best seen in FIG. 3, a lower jaw member 22 is pivotally attached to the frame 20 by a pin (not shown) extending through hole 42 in the jaw member and into hole 44 in the frame 20 in close proximity to the power unit 12. An upper ram member 24 is pivotally attached by a pin, not shown, through holes 26 in the upper ram member and holes 46 of the lower jaw member 22. Note that there are two holes 26, only one of which is visible in FIG. 3, that extend through both the upper and lower spaced sidewalls 24*a* and 24*b* of upper ram member 24 and two holes 46, only one of which is visible in FIG. 3, that extend through both the upper and lower spaced sidewalls 22*a* and 22*b* of the lower jaw member 22.

Extending from the front face 12*a* of the power unit 12 is the reciprocating drive rod 28 connected to a cam bar 30. Cam bar 30, which is preferably cylindrical, can be seen protruding through cam slots 32 in the upper ram member 24 and through cam slots 34 in the lower jaw member 22 as seen in FIGS. 1-3. Note that the cam slots 32 include a slot 32*a* in upper sidewall 24*a* and a slot 32*b* in lower sidewall 24*b* of upper ram member 24. In addition, the cam slots 34 in the lower jaw member 22 include a slot 34*a* in the upper sidewall 22*a* and a slot 34*b* in the lower sidewall 22*b*.

Referring again to FIG. 3, there is illustrated the interconnection between the front end 12*a* and the power unit 12. Two rings 12*a* and 12*b* are received within a cylindrical end housing 12*d* so that the front end 12*a* can rotate. In one embodiment, two springs 37 extend between the front end 12*a* and holes 39 in the power unit so that the front end can rotate about the axis through push rod 28, in either direction with respect to the power unit 12, as indicated by arrows 41. In an embodiment of this invention, the power stapler 10 can rotate about 90 degrees either way with respect to the power unit 12.

The key individual components of the powered stapler 10, according to the present invention, are shown in the exploded, perspective view of FIGS. 3 and 4. The main frame 20 has a cam slot 40 for the fore/aft guidance of the rod 28 with the cam bar 30 transversely affixed at its distal end. Cam slot 40 has a longitudinal, straight surface 40*a* extending the length of the cam slot from an open end 40*b*, adjacent to the power source 12, to a closed end 40*d* at the opposite end of the cam slot. Cam slot 40 has substantially parallel walls of a first width forming a first section 40*e* extending a first length from the open end 40*b* towards the closed end 40*d*. Then, the cam slot 40 narrows in a middle section 40*c*, as shown in FIG. 3, so that the wider portion can accommodate the movement of the reciprocating rod 28. The cam slot 40 has an end section 40*f*, the sides of which are essentially parallel so as to serve as a guide for the cam bar 30. The movement of the cam bar 30 in cam slot 40 is described in detail herein below.

Referring again to FIG. 3, the lower jaw member 22 includes a generally L-shaped forming die 56 which extends from an elongated edge surface 23 and has a forming head 56*a*. The lower jaw member 22 includes the spaced sidewalls 22*a* and 22*b* which include the substantially identical shaped slots 34 that are enclosed at either end, are parallel, and which overlie each other, as discussed herein above. A first section 34*a* of the slots 34 begins closer to the forming die 56 and has walls parallel to the elongated edge surface 23. A second section 34*b* of the slots 34 extends from the first section 34*a* at an angle towards the frame 20. The width of the slots 34 is slightly more than the width, i.e. the diameter, of the cam bar 30 so that when the lower jaw member 22 is assembled to the frame 20, the cam bar can easily move through the slot.

The lower jaw member 22 has a pivot hole 42 which aligns with pivot hole 44 in the main frame 20. The jaw member 22 is secured to the main frame at pivot hole 44 by conventional means such as a pin (not shown) extending through pivot hole 44 and through pivot holes 42.

The upper ram member 24 includes a hammer 52 which is mounted to a pivot hole 53 extending through both spaced sidewalls 24*a* and 24*b* of the ram member. The upper ram member 24 has an elongated edge surface 25 which is generally parallel to the edge surface 23 of the lower jaw member 22 when both the upper ram member and the lower jaw member are mounted to the frame 20 and in a state prior to actuating the powered stapler 10. The spaced sidewalls 24*a* and 24*b* of the upper ram member 24 include substantially identical shaped slots 32*a*, 32*b* which are enclosed at either end and which overlie each other. The slots 32*a*, 32*b* have parallel edges extending at an angle from the elongated edge surface 25 of upper ram member 24 towards the frame 20. The width of the slots 32 is slightly more than the diameter of the cam bar 30 so that when the ram member 24 is assembled to the lower jaw member 22 with a pivot pin (not shown) extending through holes 26 and 46, the cam bar can easily move in the slot 32. Note that the sidewalls 22*a* and 22*b* of the lower jaw member 22 are fitted between the sidewalls 24*a* and 24*b* of the upper ram member 24. As explained herein, when both the ram member 24 and the jaw member 22 are secured to the main frame 20, the cam bar 30 can easily move through both the slots 32 and the slots 34 so as bring together the upper ram member 24 and the lower jaw member 22.

The ram member 24 has two aligned pivot holes 26 through both the spaced sidewalls 24*a* and 24*b* which align with two pivot holes 46 which are themselves aligned and extend through spaced sidewalls 22*a* and 22*b* in the lower jaw 22. The pivot holes 26 and 46 have a pin (not shown) extending through them to pivotally secure the secure the upper ram member 24 to the lower jaw 22, the latter being pivotally secured to the frame 20 by a pin (not shown) extending through aligned pivot holes 42 in the sidewalls 22*a* and 22*b* and through the pivot hole 44 through the frame assembly 20.

Also attached to the front portion 20*b* of the main frame 20, as shown in FIG. 4, is a front nosepiece 48 which covers anvil 20*e*. The staple-driving hammer 52 that is pivotally attached at pivot hole 53 in ram 24 moves between the front 20*b* and the nosepiece 48 to dispense staples 36.

Also mounted to the main frame 20 is a staple strip cover 50 into which staples are loaded for delivery to the nosepiece 48. The staples may be joined together by adhesive means, tape, wire or the like into sticks of staples, as is well known in the art. A stick of staples is insertable in the staple strip cover 50. The cover 50 is disposed over an upstanding, elongated rib 20*d* to provide a guide track for the staples, as is known in the art.

As can be seen in FIG. 3, the cam bar 30 can only travel fore and aft along the longitudinal cam slot 40 in the main frame 20 when activated by the reciprocating rod 28 by the power unit 12. In the aft rest position, as shown in FIG. 1, the cam bar 30 is located at the ends of slots 32 and slots 34 closest to the power unit 12. In this position, the forming head 56*a* and the end 20*b* of the main frame 20 are separated from each other so that work pieces, as shown in FIG. 5, can be disposed between them.

When the cam bar 30 travels along cam slots 32 and cam slots 34 from the aft rest position in FIG. 1 to the fully forward position in FIG. 2, the lower jaw 22, being pivotally mounted to the main frame 20, will close the end 56*a* against the nose piece 48 of the main frame 20 as a result of the cam bar 30 traveling forward along the cam slots 34 in the jaw 22. When the cam bar 30 moves forward from its rest position in FIG. 1 to it's full forward position in FIG. 2, the cam bar also travels along the cam slots 32 in the ram 24 causing the ram 24 to travel over both the lower jaw 22 as well as over the main frame 20 and the nose piece 48. This movement of the ram 24 occurs simultaneously with the movement of the lower jaw 22 thereby clamping the jaw 22 against the anvil 20*e* to clamp against any work pieces disposed there between as well as moving the pivotally attached hammer 52 between the nosepiece 48 and the anvil 20*e* whereby the hammer separates one staple 36 from a strip, forcing the pre-formed staple through the work pieces to be attached and then fold-forming the staple against the lower jaw forming die 56*a*. The post-formed staple 38 is shown in FIG. 2 with the fastened work pieces omitted for clarity.

In FIG. 5, a power stapler 10 according to the present invention, is shown in a perspective view at the conclusion of a stapling process where a vertical metal building stud 58 is positioned inside a horizontal metal track 60 and is clamped and stapled together at their interconnection.

Although the invention has been shown and described with respect to a certain preferred embodiment or embodiments, certain equivalent alterations and modifications will occur to others skilled in the art upon the reading and understanding of this specification and the annexed drawings. In particular regard to the various functions performed by the above described components (assemblies, devices, etc.) the terms (including a reference to a "means") used to describe such components are intended to correspond, unless otherwise indicated, to any component which performs the specified function of the described component (i.e., that is functionally equivalent), even though not structurally equivalent to the disclosed structure which performs the function in the herein illustrated exemplary embodiments of the invention. In addition, while a particular feature of the invention may have been disclosed with respect to only one of several embodiments, such feature may be combined with one or more features of the other embodiments as may be desired and advantageous for any given or particular application.

The invention claimed is:

1. A powered stapler (10) for stapling together two or more metal workpieces, said powered stapler characterized by:

a main frame member (20) adapted to carry a strip of staples, the frame member having an anvil (20*e*) covered by a front nosepiece (48) at one end;

a lower jaw member (22) having a lower cam slot (34) being pivotally attached to the main frame member, the lower jaw member having a forming die (56);

an upper ram member (24) having an upper cam slot (32) and a staple-driving hammer (52), the upper ram member being pivotally attached to the lower jaw member (22);

a drive rod (28) extending from a power unit (12) and having a cam bar (30) at one end protruding through the upper cam slot (32) in the upper ram member (24) and through the lower cam slot (34) in the lower jaw member (22); and a power unit (12) mounted to the powered stapler for reciprocally driving the drive rod (28) whereby the forming die (56) engages the anvil (20*e*) for clamping the two or more metal work pieces together and for driving the staple driving hammer (52) between the front nosepiece (48) and the anvil (20*e*) for dispensing a staple (36) and driving the staple through the two or more metal work pieces whereby the staple is formed against the forming die (56).

2. The powered stapler of claim 1 further characterized in that the reciprocating drive rod (28) has a first end portion (28*a*) which is mounted to the power unit (12) and an opposite end portion (28*b*) that is transversely connected to the cam bar (30).

3. The powered stapler of claim 2 further characterized in that the main frame member (20) is mounted at an opposite end to the power unit (12).

4. The powered stapler of claim 3 further characterized in that the power unit (12) has a front end (12*a*) that includes a cylindrical end housing (12*d*) into which the first end portion (28*a*) reciprocating drive rod (28) is received and mounted to the power unit.

5. The powered stapler of claim 4 further characterized in that the front end (12*a*) of the power unit (12) can rotate in either direction about an axis through the main frame member (20).

6. The powered stapler of claim 5 further characterized in that the front end (12*a*) of the power unit (12) can rotate about 90 degrees in either direction about the axis through the main frame member (20).

7. The powered stapler of claim 1 further characterized in that the upper ram member (24) includes an upper sidewall (24*a*) and a lower sidewall (24*b*) and the lower jaw member (22) includes an upper sidewall (22*a*) and a lower sidewall (22*b*).

8. The powered stapler of claim 7 further characterized in that the cam slot (32) in the upper ram member (24) includes a first cam slot (32*a*) in the upper sidewall (24*a*) and a second cam slot (32*b*) in the lower sidewall (24*b*), the first and second cam slots being parallel to each other and disposed one above the other.

9. The powered stapler of claim 8 further characterized in that the cam slot (34) in the lower jaw member (22) includes a first slot (34*a*) in an upper sidewall (22*a*) and a second slot (34*b*) in a lower sidewall (22*b*) of upper ram member (24), the first and second cam slots being parallel to each other and disposed one above the other.

10. The powered stapler of claim 9 further characterized in that the cam slots (32*a*, 32*b*) of the upper ram member (24) have parallel edges extending at an angle from an elongated edge surface (25) of upper ram member (24) towards the frame (20).

11. The powered stapler of claim 10 further characterized in that the width of the slots (32, 34) is slightly more than the width of the cam bar (30) so that when the upper ram member (24) is assembled to the lower jaw member (22), the cam bar can easily move in the slots (32,34).

12. The powered stapler of claim 7 further characterized in that the sidewalls (22*a*,22*b*) of the lower jaw member (22) are fitted between the sidewalls (24*a*,24*b*) of the upper ram member (24).

13. The powered stapler of claim 12 further characterized in that both the upper ram member (24) and the lower jaw member (22) are secured to the main frame (20) so that the cam bar (30) can easily move through both the slots (32) and the slots (34) so as bring together the upper ram member (24) and the lower jaw member (22).

14. A method for stapling together two or more metal workpieces, said method comprising:

providing a main frame member (20) adapted to carry a strip of staples, the frame member having an anvil (20*e*) covered by a front nosepiece (48) at one end and being mounted;

pivotally attaching a lower jaw member (22) having a lower cam slot (34) and a forming die (56) at one end to the main frame member;

pivotally attaching an upper ram member (24) to the lower jaw member (22), the upper ram member (24) having an upper cam slot (32) and a staple-driving hammer (52) at one end; and reciprocally driving a drive rod (28) having a cam bar (30) at one end protruding through the upper cam slot (32) in the upper ram member (24) and through the lower cam slot (34) in the lower jaw member (22) whereby the forming die (56) initially engages the anvil (20*e*) for clamping the two or more metal work pieces together and for subsequently driving the staple driving hammer (52) between the front nosepiece (48) and the anvil for dispensing a staple (36) and driving the staple through the two or more metal work pieces whereby the staple is formed against the forming die (56).

15. The method of claim 14 further including the steps of:

mounting a first end portion (28*a*) of reciprocating drive rod (28) to a cylindrical end housing (12*d*) of a power unit (12) that can rotate in either direction and an opposite end portion (28*b*) to the cam bar (30).

16. The method of claim 14 further including the steps of:

rotating the front end (12*a*) of the power unit (12) about 90 degrees in either direction with respect to the main frame member (20).

17. The method of claim 16 further including the steps of:

moving the cam bar (30) along cam slots (32) and cam slots (34) from the aft rest position to the fully forward position whereby the lower jaw (22) will close the end (56*a*) against the anvil (20*e*) of the main frame (20).

18. The method of claim 17 further including the steps of:

moving the cam bar along the cam slots (32) in the ram (24) causing the upper ram (24) to travel over both the lower jaw (22) as well as over the main frame (20) and the nose piece (48).

19. The method of claim 14 further including the steps of:

separating the forming head (56*a*) and the end (20*b*) of the main frame (20) from each other when the cam bar (30) is at aft position at the ends of upper cam slots (32) and lower cam slots (34) so that the two or more work pieces can be disposed between them.

20. The method of claim 19 further including the steps of:

simultaneously moving upper ram (24) with the movement of the lower jaw (22) thereby clamping the lower jaw (22) onto the anvil (20*e*) as well as moving the pivotally attached hammer (52) between the nosepiece (48) and the anvil whereby the hammer separates a staple (36) from a strip, forcing the staple through the materials to be attached and then fold-forming the staple against the lower jaw forming die (56*a*).

* * * * *